US006412202B1

(12) United States Patent
Oswood

(10) Patent No.: US 6,412,202 B1
(45) Date of Patent: Jul. 2, 2002

(54) SIGNAGE DISPLAY FOR VEHICLES

(75) Inventor: Jon W. Oswood, Cedar Rapids, IA (US)

(73) Assignee: Bragtag, Inc., Cedar Rapids, IA (US)

( * ) Notice: Subject to any disclaimer, the term of this patent is extended or adjusted under 35 U.S.C. 154(b) by 0 days.

(21) Appl. No.: 09/407,251

(22) Filed: Sep. 28, 1999

(51) Int. Cl.[7] ..... G09F 21/04
(52) U.S. Cl. ..... 40/591; 40/204; 40/541
(58) Field of Search ..... 40/591, 541, 204, 40/205, 206, 556, 620; 224/519; 280/507; 403/365, 366, 377, 378, 399.1

(56) References Cited

U.S. PATENT DOCUMENTS

| | | | | | |
|---|---|---|---|---|---|
| 1,127,895 | A | * | 2/1915 | Kahn | 40/620 |
| 2,525,001 | A | * | 10/1950 | Sherwood | 40/591 |
| 4,977,695 | A | * | 12/1990 | Armbaster | 40/541 |
| 5,092,503 | A | | 3/1992 | Cocks | |
| 5,570,826 | A | | 11/1996 | Garbes et al. | |
| 5,603,178 | A | | 2/1997 | Morrison | 40/591 |
| 5,642,844 | A | | 7/1997 | Rector | |
| D399,805 | S | | 10/1998 | Donalies | |
| 5,829,774 | A | | 11/1998 | Klemp | |
| 5,979,094 | A | * | 11/1999 | Brafford, Jr. | 40/591 |
| 6,007,033 | A | * | 12/1999 | Casson et al. | 248/224.7 |
| 6,079,136 | A | * | 6/2000 | Kozlarek | 40/541 |
| 6,092,656 | A | * | 7/2000 | Ernst | 206/378 |
| 6,199,892 | B1 | * | 3/2001 | Dahl | 280/507 |
| 6,247,257 | B1 | * | 6/2001 | Powell | 40/591 |
| 6,253,476 | B1 | * | 7/2001 | Powell | 40/591 |

FOREIGN PATENT DOCUMENTS

| | | | |
|---|---|---|---|
| GB | 2 029 621 A | 3/1980 | 40/591 |

* cited by examiner

*Primary Examiner*—Jack Lavinder
*Assistant Examiner*—William L. Miller
(74) *Attorney, Agent, or Firm*—Shook, Hardy & Bacon L.L.P.

(57) ABSTRACT

A signage display for a vehicle having a hitch receiver is provided that includes a frame defining a placard receiving area. A tongue is coupled to the frame that extends rearwardly from the frame and away from the receiving area. The tongue is adapted to be received within the hitch receiver of the vehicle. A placard is removably coupled to the frame within the placard receiving area of the frame. The signage display may thus be removably coupled to the hitch receiver of the vehicle. The vehicle owner may change the placard within the receiving area to display a variety of messages, thus alleviating the problem associated with conventional bumper stickers. In one embodiment, the frame is provided with a light socket and light that allow the placard to be illuminated.

8 Claims, 2 Drawing Sheets

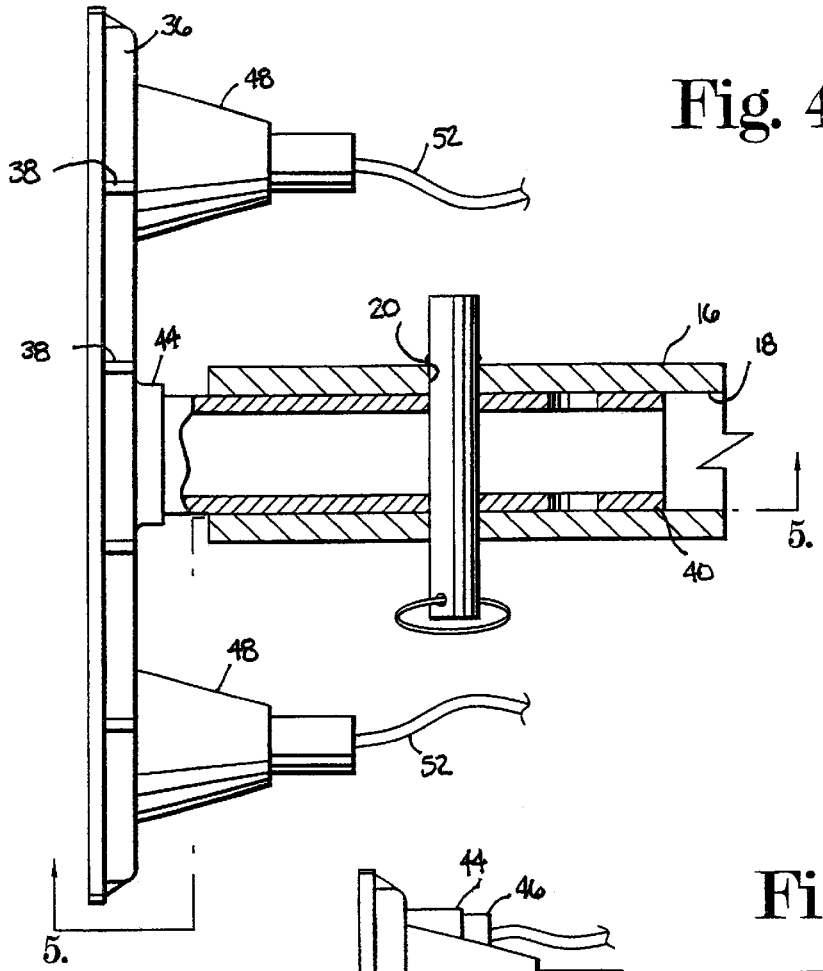
Fig. 4.
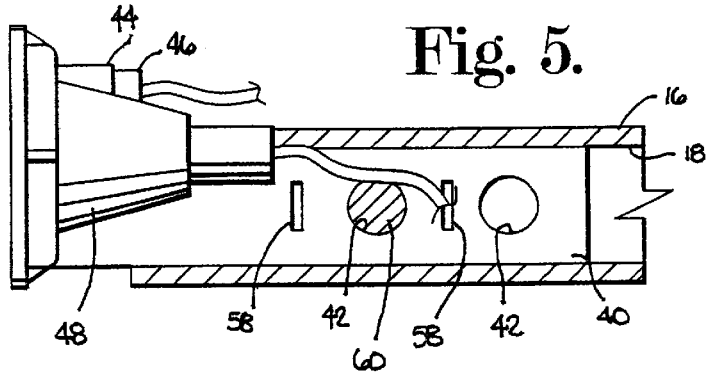
Fig. 5.
Fig. 6.
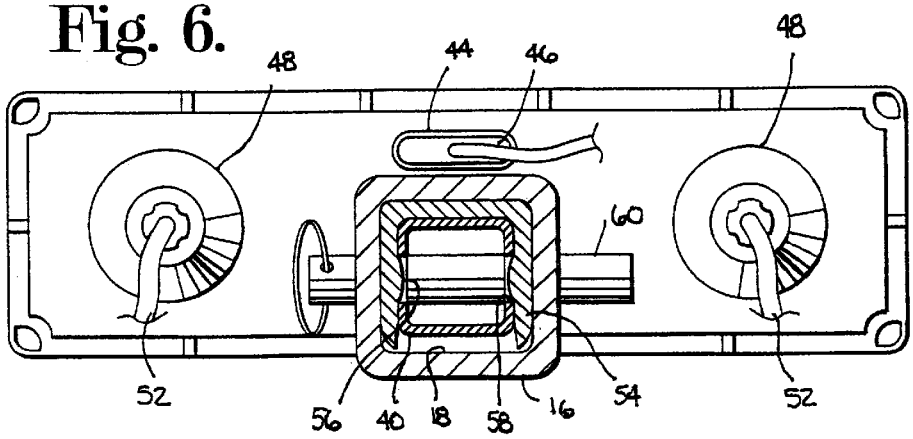

SIGNAGE DISPLAY FOR VEHICLES

BACKGROUND OF THE INVENTION

The present invention relates generally to signage displays for vehicles. More specifically, the invention is directed to a signage display for a vehicle that is adapted to be received within the hitch receiver of the vehicle and that allows the particular display to be replaced as desired by the vehicle owner.

Many vehicles today are equipped with hitch receivers. These hitch receivers allow the owners and operators of the vehicles to tow trailers, boats and other items when necessary. The typical hitch receiver is located below the rear bumper of the vehicle and has a generally square opening therein. The opening accommodates a ball hitch for trailers or other towed items having a mating towing arrangement.

When a hitch is not received within the opening of the hitch receiver, it is exposed to roadway dirt and grime. This dirt and grime can partially obstruct the hitch receiver opening, making it more difficult to properly install a towing hitch when desired. Prior art devices exist that do offer some protection to the hitch receiver opening. These devices, however, also suffer from a number of drawbacks.

The typical prior art device operates to plug the hitch receiver opening when a hitch is not coupled to the vehicle. Some of these prior art devices also offer a display of some kind, such as a particular brand of vehicle. The display, however, is not lighted and is therefore not as visible during night driving as may be desired by the driver of the vehicle. Further, the prior art devices have not offered any adjustment mechanism to accommodate vehicles having different sizes of hitch receiver openings. Therefore, when using these prior art devices, the vehicle owner must purchase and use a device that corresponds exactly to the hitch receiver of the vehicle. Thus, these prior art devices are not readily transferable from one vehicle to another, making their use somewhat limited.

The prior art devices have also heretofore not been equipped with any mechanism offering protection to the electrical connector of the vehicle. Many vehicles equipped with a hitch receiver are also equipped with an electrical connector that is used to provide power to the trailer being towed by the vehicle. Typically, this power allows the turn signals, brake lights and other lighting on the trailer to be operated by the vehicle performing the towing. When the vehicle is not towing anything, the electrical connector is not coupled to anything, leaving it exposed to possible damage. As stated above, the prior art devices designed to be installed within the hitch receiver do not have any mechanism offering protection to this electrical connector when it is not in use.

Prior art devices also offer no mechanism for changing the display of the device without installing a completely new device. It would be desirable to allow the owner or operator of the vehicle to change the display. For example, the display could be changed to reflect a different sports team according to the change in season. As another example, a particular political message could be displayed and changed if desired. Prior art "bumper stickers" do allow a variety of messages to be displayed on a vehicle. However, the use of bumper stickers is also problematic due to the relative permanence of the sticker. In other words, bumper stickers cannot be changed as easily as is desired by many vehicle owners.

Therefore, a signage display for a vehicle is needed that overcomes the above drawbacks and disadvantages existing in the prior art. More specifically, a signage display is needed that protects the hitch receiver and electrical connector of the vehicle. Further, a signage display is needed that can be illuminated and that allows the particular display to be changed according to the desires of the vehicle owner. Still further, a signage display is needed that is adaptable for use on vehicles having varying sizes of hitch receivers.

BRIEF SUMMARY OF THE INVENTION

It is an object of the present invention to provide a signage display for a vehicle that protects the hitch receiver from roadway grime and debris and that provides protection for the electrical connector of the vehicle as well.

It is another object of this invention to provide a signage display for a vehicle that allows a placard to be removably coupled to the display so that the placard can easily be changed by the owner or operator of the vehicle.

It is a further object of the invention to provide a signage display that may be adjusted to compensate for vehicles that have differing hitch receiver openings.

It is yet another object of the invention to provide a signage display that may be illuminated so as to better display a placard thereon.

According to the present invention, the foregoing and other objects are attained by a signage display for a vehicle having a hitch receiver. The display includes a frame defining a placard receiving area. A tongue is coupled to the frame that extends rearwardly from the frame and away from the receiving area. The tongue is adapted to be received within the hitch receiver of the vehicle. A placard is removably coupled to the frame within the placard receiving area of the frame. The signage display may thus be removably coupled to the hitch receiver of the vehicle. The vehicle owner may change the placard within the receiving area to display a variety of messages, thus alleviating the problem associated with conventional bumper stickers. In one embodiment of the invention, the fame is provided with a light socket and light that allow the placard to be illuminated.

Additional objects, advantages, and novel features of the invention will be set forth in part in the description which follows, and in part will be apparent to those skilled in the art upon examination of the following, or may be learned from practice of the invention.

BRIEF DESCRIPTION OF THE DRAWINGS

In the accompanying drawings which form a part of this specification and which are to be read in conjunction therewith and in which like reference numerals are used to indicate like parts in the various views:

FIG. 4 is a top plan view of the display of FIG. 1, with parts being broken away to show particular details of construction;

FIG. 5 is a view taken along line 5—5 of FIG. 4; and

FIG. 6 is a view similar to FIG. 3, showing the use of an adapter to accommodate a larger hitch receiver.

DETAILED DESCRIPTION OF THE INVENTION

Figure 1:
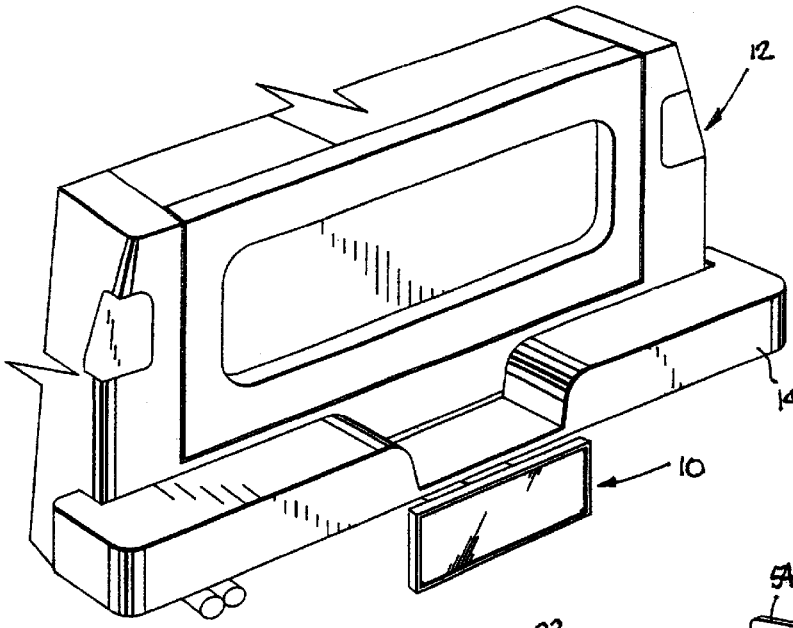
FIG. 1 is a perspective view of the signage display of the present invention, shown installed within the hitch receiver of a vehicle.

Referring initially to FIG. 1, a vehicle signage display according to the present invention is broadly designated in the drawings by the reference numeral 10. Display 10 is shown in FIG. 1 installed on a vehicle 12 generally below the rear bumper 14 of the vehicle. Vehicle 12 is provided with a hitch receiver 16, as best seen in FIG. 4. Receiver 16 typically has a generally square or rectangular opening 18, into which may be installed a towing hitch or the display 10. As best seen in FIG. 4, receiver 16 is also equipped with at least one retaining hole 20, the importance of which is more fully described below.

Figure 2:
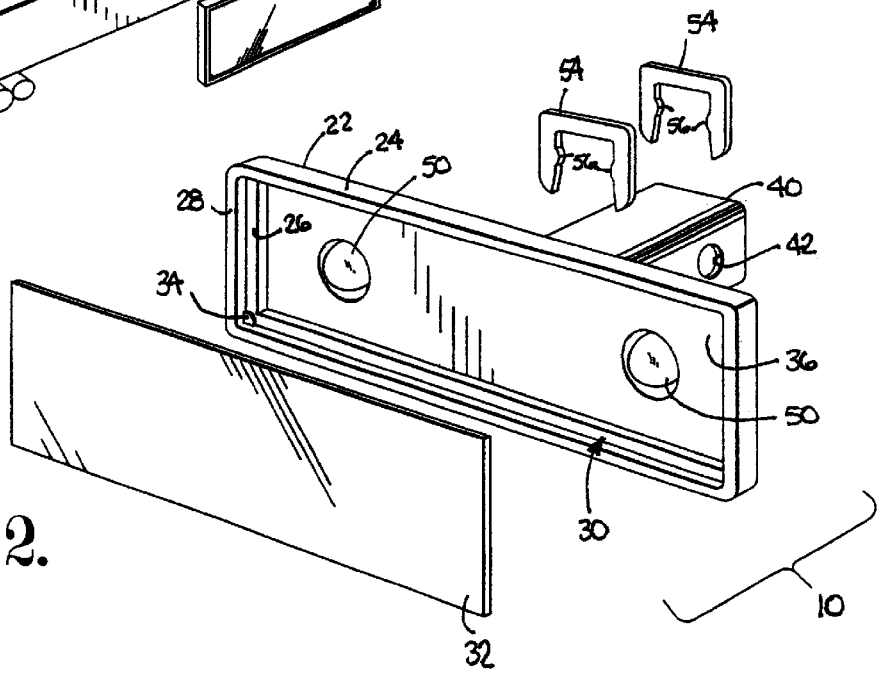
FIG. 2 is an exploded view of the display of FIG. 1 installed within the hitch receiver of a vehicle.

Display 10 includes a frame 22 that includes an outer wall 24. As best seen in FIG. an inner lip 26 extends inwardly from wall 24 below a top surface 28 of wall 24. Outer wall 24 and lip 26 define a placard receiving area 30. Area 30 accommodates a placard 32, as is more fully described below. As best seen in FIG. 2, extending inwardly from wall 24 and spaced from lip 26 are a plurality of retaining ears 34. While only one ear 34 is shown in FIG. 2, in the preferred embodiment each of the four comers of area 30 has an ear 34. It should be understood that more or fewer than four ears 34 may be provided, so long as placard 32 is retained within area 30.

Figure 3:
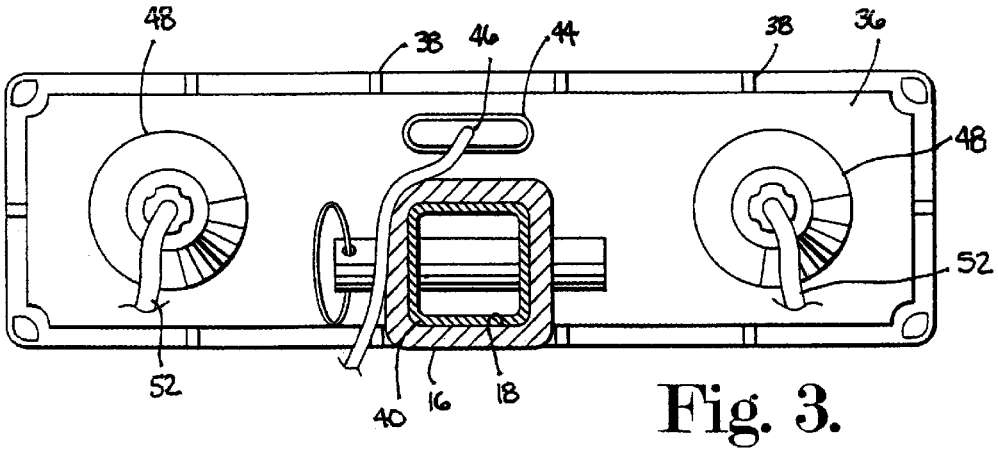
FIG. 3 is a rear elevation view of the display of FIG. 1.

As best seen in FIG. 2, lip 26 is also spaced from a rear wall 36 of frame 22. As best seen in FIG. 3, rear wall 36 is equipped with a plurality of reinforcing ribs 38. Ribs 38 are preferably integrally molded with wall 36 and offer structural stability to frame 22. Rear wall 36 has a tongue 40 extending outwardly therefrom. Preferably, tongue 40 is integrally molded with frame 22, but could be coupled to rear wall 36 with any suitable attaching mechanism, such as by welding, bonding or through the use of adhesives. Tongue 40 is molded to a shape and size that matches that of opening 18 in hitch receiver 16. Further, although tongue 40 is shown as being a generally hollow member, it should be understood that tongue 40 could also be a solid member. As best seen in FIG. 5, tongue 40 has a number of retaining holes 42 disposed therethrough. Preferably, a pair of holes 42 is provided at each location, the holes being aligned with one another. A series of holes 42 may be provided along the length of tongue 40 to allow display 10 to be moved inwardly or outwardly as desired. As shown in FIG. 5, two pairs of holes 42 are provided. Tongue 40 is preferably offset from the vertical center of frame 22. This placement of tongue 40 allows for some flexibility in the location of the display relative to the vehicle on which it is placed, such as may be needed for clearance of a bumper.

As best seen in FIG. 3, located above tongue 40 on wall 36 is a connector socket 44. Socket 44 is preferably molded integrally with rear wall 36 and protrudes outwardly therefrom. It should be understood that socket 44 could be molded separately and coupled to wall 36 with any suitable attaching mechanism, such as by welding, bonding or through the use of adhesives. Socket 44 is of a size and shape that accommodates an electrical connector 46 of vehicle 12, as best seen in FIGS. 3, 5 and 6. Connector 46 can be protected when not in use by installing the connector within socket 44.

In one embodiment of the invention, frame 22 is provided with lights so that placard 32 can be illuminated. Rear wall 36 of frame 22 therefore has a pair of light sockets 48 coupled thereto. Preferably, sockets 48 are integrally molded into wall 36, but could also be manufactured and installed separately. Sockets 48 are formed to accommodate a light bulb 50, as best seen in FIG. 2. Each socket 48 has electrical wiring 52 associated therewith, as is known in the art. Preferably, wiring 52 is supplied with power from vehicle 12, so that a separate power source is not needed. As shown, a pair of sockets 48 and bulbs 50 are provided. It should be understood that a single socket and bulb could be used, and that more sockets and bulbs could also be used as desired.

As described above, a placard 32 is installed on frame 22 within receiving area 30. Placard 32 is preferably made from a molded plastic material and is made to carry a design, message or graphic of some kind. This graphic could be imprinted directly on placard 32, or may be applied to placard 32, such as by an adhesive. For example, placard 32 could carry a particular political message, by indicating support for a particular candidate, or could carry a message or design indicating support for a particular athletic team. Alternatively, placard 32 could indicate the brand of the vehicle or dealership. It should be understood that the invention is not in any way limited to the type of message, design or graphic being displayed, as placard 32 could carry a variety of messages, designs or graphics. Placard 32 is made of a material, such as plastic, that allows the placard to be slightly bowed or bent and installed under retaining ears 34. Once disposed below ears 34, placard 32 is held in place on frame 22. Mechanisms other than ears 34 could be used to removably hold placard 32 in place. For example, screws or a hook-and-loop fastening device could be employed. Placard 32 merely needs to be easily removed by the vehicle owner or operator while remaining in place during normal use.

An alternative embodiment for display 10 is shown in FIGS. 2 and 6. In this embodiment, a number of adjusting clips 54 are provided. Each clip 54 is generally u-shaped and has an outer dimension matching that of opening 18 in hitch receiver 16. Clips 54 are used when tongue 40 is of a smaller outer dimension that opening 18, and operate to maintain display 10 securely on vehicle 12. The inner legs of each clip 54 have a locking tab 56 located generally midway along the leg. Below each tab 56, the legs are tapered to allow the tab to be easily installed on tongue 40. As best seen in FIG. 5, tongue 40 has a pair of spaced locking slots 58 disposed therethrough. Slots 58 are provided to hold clips 56 in place. As best seen in FIG. 6, when tongue 40 is of a smaller outer dimension that opening 18 in hitch receiver 16, clips 54 are used to fill the space between tongue 40 and opening 18.

Clips 54 are installed on tongue 40 by first aligning the clip with a slot 58. The clip is thereafter pushed onto tongue 40, with the taper in each leg of clip 54 operating to cam the leg slightly outwardly. Each clip 54 is pushed onto tongue 40 until locking tabs 56 are within locking slots 58. Clips 54 are made of a slightly resilient material, such that when tabs 56 are in alignment with slots 58, the tabs will move inwardly and be held in place by slots 58. As can be understood, clips 54 therefore allow display 10 to be used on a variety of hitch receivers 16 having a variety of openings 18. Alternative clips 54 could also be used to adapt tongue 40 to the size of the hitch receiver 16. For example, a sleeve dimensioned to fit over tongue 40 and within hitch receiver 16 could be used. Such a sleeve is preferably made from a slightly resilient material, such as rubber. In other words, clips 54 are used to adapt tongue 40 to different sizes of hitch receivers.

Display 10 can easily be installed in hitch receiver 16 by placing tongue 40 within opening 18. If tongue 40 does not fit snugly within receiver 16, clips 54 are first installed on tongue 40. Tongue 40 is located within hitch receiver 16 such that retaining holes 42 of tongue 40 are aligned with retaining holes 20 of receiver 16. Thereafter, a retaining pin 60 is placed through holes 42 and 20 to retain display 10 in place within hitch receiver 16. As described above, if display 10 is equipped with lights 50, the electrical wiring 52 is connected as is known in the art. To facilitate easy connection of this wiring, a quick-disconnect type connector may be used for wiring 52. Further, if vehicle 12 is equipped with an electrical connector 46, it may be placed within socket 44 to protect the connector from possible damage. Placard 32 containing the desired message, design or graphic may be installed within receiving area 30 and will be held in place by ears 34.

It can therefore be understood that the invention provides a signage display that protects the hitch receiver of the vehicle and that provides protection for the electrical connector of the vehicle as well. The invention further provides a display with a placard that can be removed and changed as desired, and that can be illuminated for better visibility. Still further, the invention may be adjusted to accommodate varying sizes of hitch receiver openings.

From the foregoing, it will be seen that this invention is one well adapted to attain all of the ends and objects hereinabove set forth, together with other advantages which are inherent to the structure. It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A signage display for a vehicle having a hitch receiver, comprising:

a frame defining a placard receiving area;

a plurality of retaining ears spaced about an outer edge of said receiving area;

a tongue coupled to said frame and extending away from said receiving area, said tongue adapted to be received within the hitch receiver of the vehicle;

a plurality of adjusting clips adapted to be placed at least partially about said tongue, said clips providing an enlarged outer dimension to said tongue so that the signage display may be used on a vehicle having a hitch receiver with an opening that is larger than said tongue; and a flexible placard removably coupled to said frame within said placard receiving area of said frame, said retaining ears being spaced to block entry of said placard unless said placard is flexed and released, wherein the signage display may be removably coupled to the hitch receiver of the vehicle by placing said tongue within the hitch receiver, and wherein said placard may be changed to display a variety of messages.

2. The signage display of claim 1, wherein the vehicle has an electrical connector associated therewith and extending therefrom, the display further comprising a socket to said frame, said socket being adapted to house and protect the electrical connector of the vehicle.

3. The signage display of claim 2, wherein said frame is equipped with at least one light socket adapted to receive a light bulb, so that said placard may be illuminated.

4. A removable signage display for a vehicle having a hitch receiver and an electrical connector, said display comprising:

a frame defining a placard receiving area;

a tongue coupled to said frame and extending rearwardly away from said receiving area, said tongue adapted to be received within the hitch receiver;

a plurality of adjusting clips adapted to be placed at least partially about said tongue, said clips providing an enlarged outer dimension to said tongue so that the signage display may be used on a vehicle having a hitch receiver with an opening that is larger that said tongue;

placard coupled to said frame within said placard receiving area of said frame; and an electrical socket coupled to said frame, said socket being adapted to house and protect the electrical connector of the vehicle, wherein the signage display may be removably coupled to the hitch receiver of the vehicle by placing said tongue within the hitch receiver, and wherein said socket provides protection to the electrical connector of the vehicle when the connector is not in use.

5. The display of claim 4, wherein said placard is removably coupled to said frame.

6. The display of claim 4, further comprising at least one light socket coupled to said frame and disposed behind said placard, said socket being adapted to receive a light so that said placard can be illuminated.

7. A removable signage display for a vehicle having a hitch receiver, said display comprising:

a frame defining a placard receiving area;

a tongue coupled to said frame and extending rearwardly away from said receiving area, said tongue adapted to be received within the hitch receiver;

a plurality of adjusting clips adapted to be placed at least partially about said tongue, said clips providing an enlarged outer dimension to said tongue so that the signage display may be used on a vehicle having a hitch receiver with an opening that is larger than said tongue;

a placard coupled to said frame within said placard receiving area of said frame; and at least one light socket coupled to said frame and disposed behind said placard, said socket being adapted to receive a light so that said placard can be illuminated, wherein the signage display may be removably coupled to the hitch receiver of the vehicle by placing said tongue within the hitch receiver, and wherein said placard can be illuminated.

8. The display of claim 7, wherein said placard is removably coupled to said frame.

* * * * *